US005868540A

United States Patent [19]

Hirose et al.

[11] Patent Number: 5,868,540

[45] Date of Patent: Feb. 9, 1999

[54] STORAGE METHOD AND APPARATUS

[75] Inventors: Toshiaki Hirose; Katsuyoshi Yatou, both of Gifu, Japan

[73] Assignee: Fuji Hensokuki Co., Ltd., Gifu-ken, Japan

[21] Appl. No.: 627,148

[22] Filed: Apr. 3, 1996

[30] Foreign Application Priority Data

Apr. 5, 1995 [JP] Japan ..... 7-080462

[51] Int. Cl.[6] ..... E04H 6/12

[52] U.S. Cl. ..... 414/234; 414/239; 414/241

[58] Field of Search ..... 414/234, 239–241, 414/243–246, 254, 260, 263, 264, 669, 670, 672

[56] References Cited

U.S. PATENT DOCUMENTS

| | | | |
|---|---|---|---|
| 4,166,546 | 9/1979 | English | 414/246 X |
| 5,118,239 | 6/1992 | Morioka | 414/235 |
| 5,314,284 | 5/1994 | Tsai | 414/234 |
| 5,330,305 | 7/1994 | Go | 414/243 X |
| 5,467,561 | 11/1995 | Takaoka | 414/239 X |

FOREIGN PATENT DOCUMENTS

| | | | |
|---|---|---|---|
| 0445080 A2 | 9/1991 | European Pat. Off. . | |
| 0572928 A1 | 12/1993 | European Pat. Off. . | |
| 0207573 | 8/1989 | Japan | 414/234 |
| 0275864 | 11/1989 | Japan | 414/263 |
| 0035173 | 2/1990 | Japan | 414/260 |
| 0176078 | 7/1990 | Japan | 414/254 |
| 0186070 | 7/1990 | Japan | 414/260 |
| 3197775 | 8/1991 | Japan | 414/234 |
| 3202571 | 9/1991 | Japan | 414/254 |
| 3224972 | 10/1991 | Japan | 414/234 |
| 4068177 | 3/1992 | Japan | 414/239 |
| 4353175 | 12/1992 | Japan | 414/239 |
| WO 94/19566 | 9/1994 | WIPO . | |

*Primary Examiner*—James W. Keenan

*Attorney, Agent, or Firm*—Limbach & Limach L.L.P.; Seong-Kun Oh

[57] ABSTRACT

A vehicle storage apparatus including a plurality of storage frames. The apparatus is provided with a passage, which is located at the middle section of the frames, along the length of the apparatus. Storage compartments are provided at the left and right sides of the passage. Each compartment is provided with a transfer tray. An orienting tray is provided in a compartment of one of the frames. The orienting tray is moved between its associated compartment and a carriage. The transfer tray is also moved laterally between the compartments and the carriage. When a vehicle is stored in or retrieved from a designated compartment, the carriage is moved carrying the transfer tray. The orienting tray is accommodated in its associated compartment in this state.

1 Claim, 7 Drawing Sheets

STORAGE METHOD AND APPARATUS

BACKGROUND OF THE INVENTION

1. Field of the Invention

The present invention relates to a storage system, and more particularly, to a storage system for vehicles.

2. Description of the Related Art

Existing vehicle storage apparatuses are known to include a main frame and a plurality of sub-frames. The main frame is provided with a loading station from where vehicles are stored or retrieved. A vertical elevator path is defined in each frame. The bottoms of the frames are connected to each other by a transfer passage, which extends horizontally.

An elevator that lifts and lowers vehicles between each level is provided in each elevator path. A transport carriage, which transfers vehicles, is provided in the passage. Storage compartments are provided on both left and right sides of each elevator path at each level. Each storage compartment is provided with a carry tray, which moves sideways between the associated compartment and the elevator path.

In this conventional appratus, to store a vehicle in the main frame at a designated storage compartment, the vehicle is first moved onto the elevator at the loading station. The elevator then lifts the vehicle to a position beside the designated compartment. Afterwards, the tray of the compartment moves sideways into the elevator path. The vehicle is then transferred to the tray and is subsequently carried into the designated compartment by the tray.

For storing a vehicle in one of the sub-frames, the vehicle is first moved onto the elevator at the loading station in the main frame and then transferred to the transport carriage. The carriage then transports the vehicle to the sub-frame of the designated compartment. The vehicle is then transferred to the elevator of the sub-frame and subsequently stored in the designated compartment in the same manner as above.

To retrieve the vehicle from the designated storage compartment of the main frame, the elevator is moved to a position beside the compartment. The tray, which the stored vehicle is carried on, is moved into the elevator path. The vehicle is then transferred to the elevator and subsequently moved to the loading station. The vehicle is then removed from the vehicle storage apparatus by driving it out from the loading station.

To retrieve the vehicle from one of the sub-frames, the vehicle is transferred to the elevator in the designated sub-frame. The vehicle is then transferred to the carriage and transported to the main frame. Afterwards, the vehicle is transferred to the elevator of the main frame at the loading station and removed from the vehicle storage apparatus by driving it out.

There are apparatuses in which a turntable is provided on the carriage to reverse the orientation of the vehicle. The turntable is supported by the carriage such that it rotates in a horizontal plane. A vehicle is placed on the table during retrieval and rotated 180 degrees to reverse its orientation. This enables the vehicle to be driven forward both when exiting and entering the loading station. However, in such a vehicle storage apparatus, since the carriage travels together with the turntable, the weight of the turntable slows the traveling speed of the carriage. This increases the time necessary to transport the vehicle between the main frame and each sub-frame. This hinders efficient storing and retrieving of vehicles. In addition, the load of the vehicle causes undesirable swaying of the table during rotation.

SUMMARY OF THE INVENTION

Accordingly, it is a primary objective of the present invention to provide a storage system that enables an increase in the traveling speed of the carriage and allows efficient storing and retrieving of objects.

It is another objective of the present invention to provide a storage system that enables objects to be stored at storing compartments located beside elevator paths.

A further objective of the present invention is to provide a storage system that enables stable rotation of the turntable.

To achieve the foregoing and other objects and in accordance with the purpose of the present invention, a storage apparatus for storing objects includes a set of storage compartments arranged in a group, a transfer passage, an elevator path, movable trays, and an orienting tray. One of the compartments are reserved. The transfer passage is located adjacent to the group of storage compartments to provide access to the compartments. The elevator path is located within the passage. The movable trays selectively transfer the objects from the elevator to each compartment and from the compartments to the elevator. The orienting tray is selectively movable between the reserved compartment and the elevator path. The orienting tray is adapted to receive an object from the elevator when the orienting tray is moved to the elevator path and is adapted to re-orient an object within a plane. The elevator is adapted to remove a re-oriented object from the turntable when the tray is located in the elevator path.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A preferred embodiment according to the present invention will now be described with reference to FIGS. 1 through 7.

Figure 1:
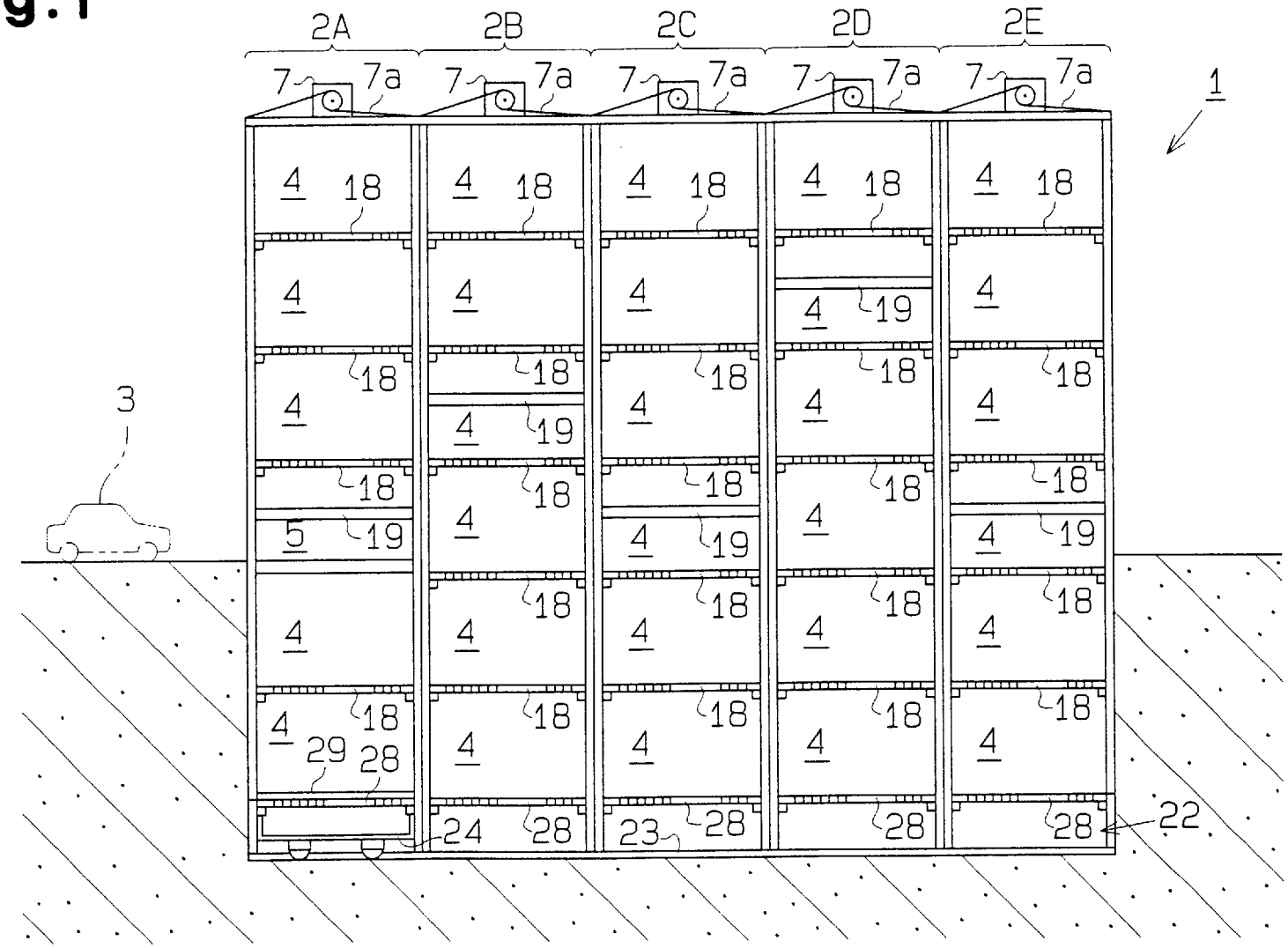
FIG. 1 is a diagrammatic cross-sectional side view showing a vehicle storage apparatus according to the present invention.

As shown in FIG. 1, a storage system, or a half-underground type vehicle storage apparatus 1, has a row of storage frames 2A, 2B, 2C, 2D, 2E. Storage compartments 4 are provided at a plurality of levels in the frames 2A–2E to store objects, or vehicles 3. Loading stations 5 are provided at the ground level of the frame 2A. Vehicles 3 are stored and retrieved from the loading stations 5. The levels in the frames 2B–2E that correspond to the level of the loading stations 5 in frame 2A are each provided with the same compartments 4 as at the other levels. The frames 2B–2E have a structure identical to the upper levels of the frame 2A. Therefore, sections in frame 2B–2E that are identical to sections of the frame 2A will be denoted with the same reference numerals and will not be described in detail.

Figure 2:
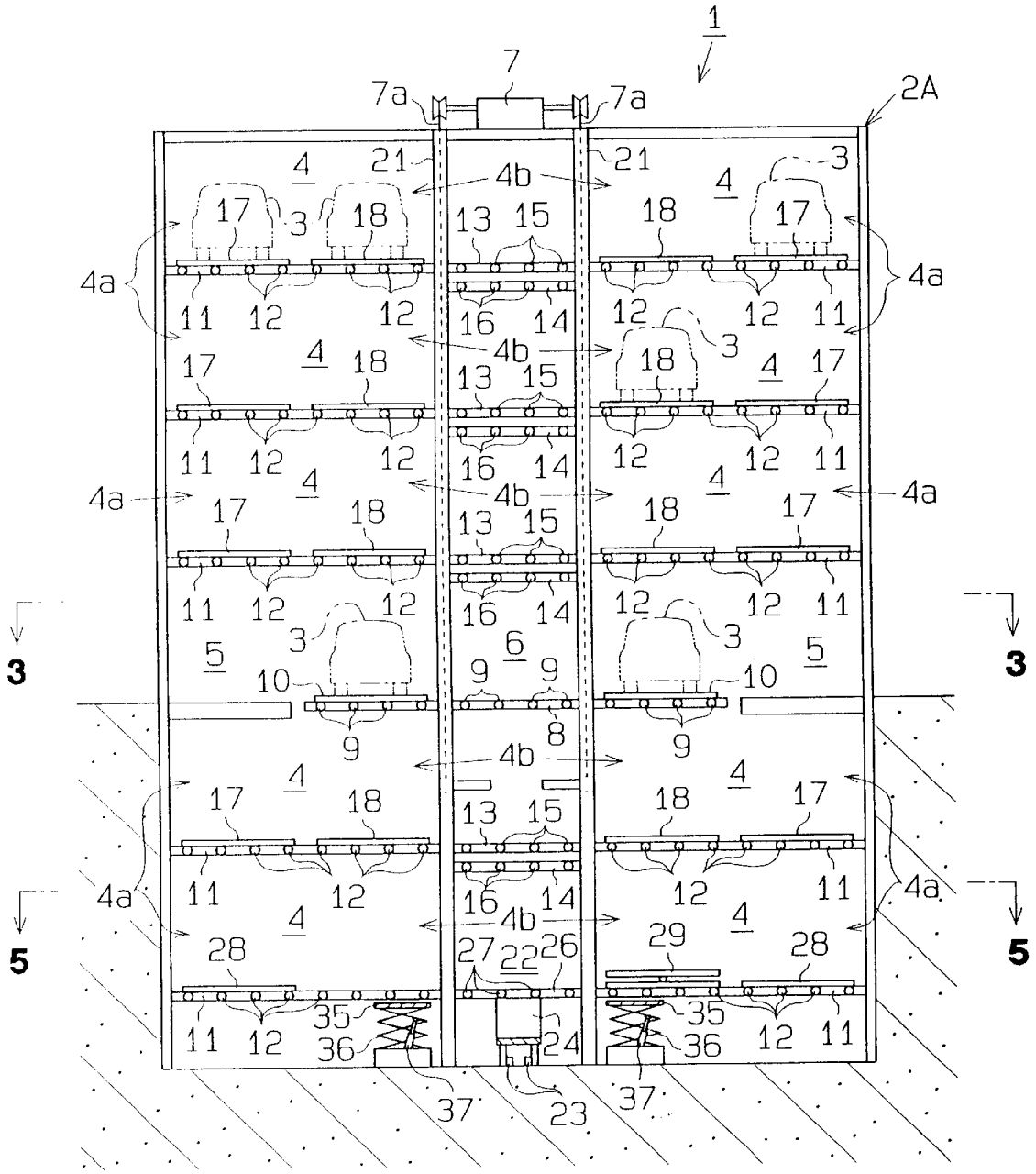
FIG. 2 is a diagrammatic cross-sectional front view showing the vehicle storage apparatus.

Initially, frame 2A will be described. As shown in FIG. 2, a vertically extending elevator path 6 is provided at the middle section of the frame 2A. A winch 7 is provided at a position corresponding to the elevator path 6 above the frame 2A. The loading stations 5 are located at each side of the elevator path 6 on the ground level of frame 2A. Guide rails 8, which extend into the elevator path 6, are provided in the loading stations 5. A plurality of rollers 9, which are rotatable in both forward and reverse directions, are supported by the rails 8. Loading carriages 10 are supported by the rollers 9. Comb-shaped prongs (not shown) are provided on the left and right sides of each carriage 10.

Levels of compartments 4 are provided both above and below the loading station 5. Each compartment 4 is capable of accommodating two vehicles 3 arranged side by side. In other words, a first storing space 4*a* and a second storing space 4*b*, each capable of accommodating a single vehicle 3, are defined in each compartment 4 to the sides of the elevator path 6. Guide rails 11, which extend laterally through the first and second storing spaces 4*a*, 4*b*, are provided in each compartment 4. A plurality of rollers 12, which are rotatable in both forward and reverse directions, are provided along the rails First and second tray rails 13, 14 are provided in the elevator path 6 at positions corresponding to the guide rails 11 (except for the rails 11 at the lowermost level). The first and second rails 13, 14 extend laterally and are overlapped with each other. A plurality of rollers 15, 16, which are rotatable in both forward and reverse directions, are provided along the rails 13, 14, respectively. Both rails 13, 14 are lifted and lowered to allow each of the rails 13, 14 to be positioned at the height of the guide rail 11.

Figure 3:
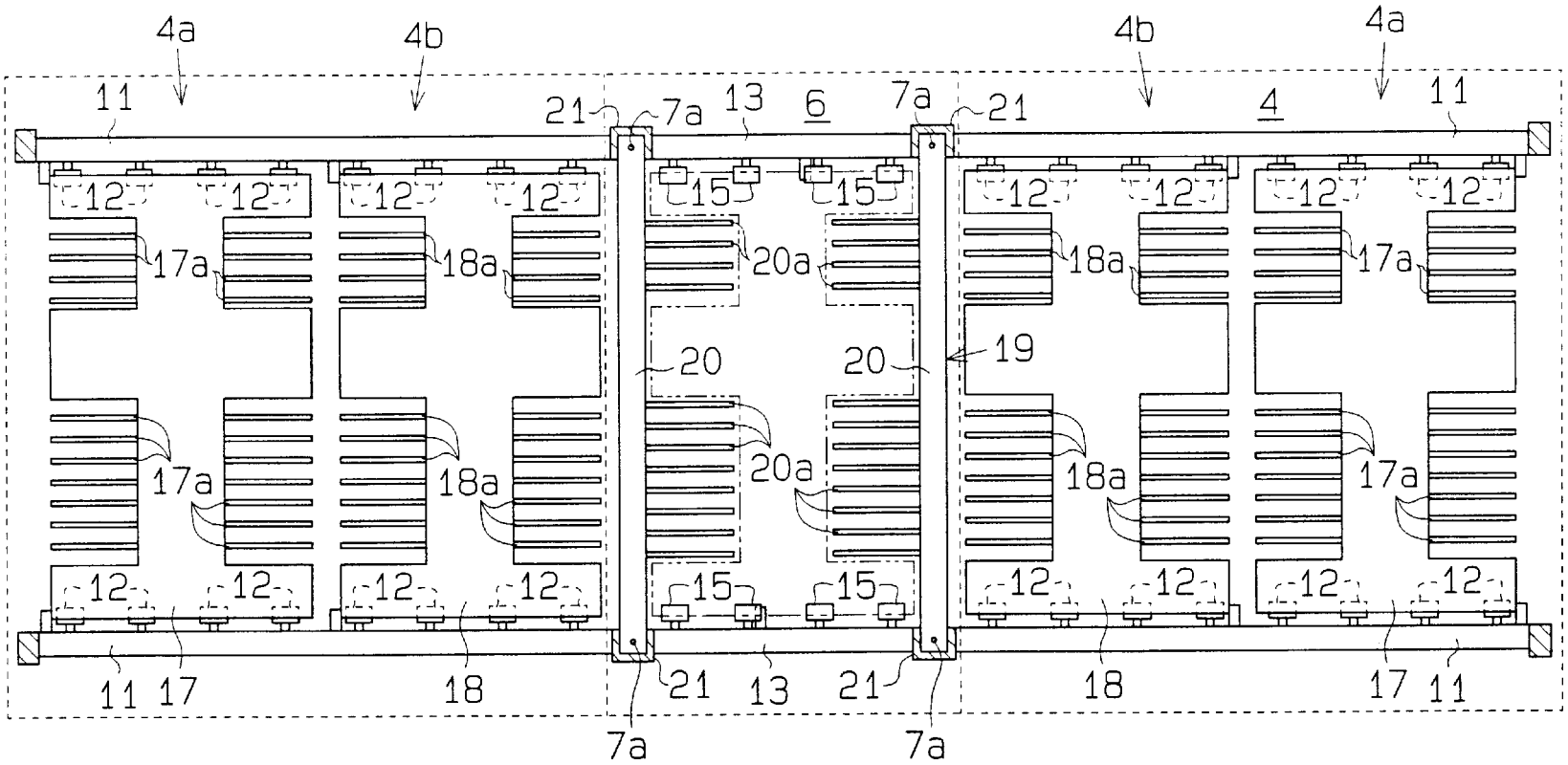
FIG. 3 is an enlarged diagrammatic cross-sectional view of a single storage frame as seen from the plane indicated by line 3—3 in FIG. 2.

As shown in FIG. 3, a first carry tray 17 is supported by the rollers 12 of the guide rails 11 in the first storing space 4*a* of each compartment 4 (except for the compartments 4 at the lowermost level). A second carry tray 18 is supported by the rollers 12 of the guide rails 11 in the second storing space 4*b*. Comb-like prongs 17*a*, 18*a* are formed in the left and right sides of the carry trays 17, 18, respectively, having shapes identical to the prongs of the carriages 10.

Elevators 19, which lift and lower vehicles 3, are provided in the elevator paths 6. As shown in FIG. 3, each elevator 19 includes a pair of elevator frames 20 provided on the left and right sides of each elevator path 6. Each elevator 19 also includes comb-like prongs 20*a*, which project from the frames 20 toward each other. The prongs 20*a* are located alternately with respect to the prongs 17*a*, 18*a* of the first and second trays 17, 18. The ends of the two frames 20 in the four corners of each elevator path 6 each engage with a vertical frame 21. Furthermore, the ends of both elevator frames 20 are each connected to a cable 7*a*, which extends from the winch 7. The elevator 19 is lifted or lowered by driving the winch 7 and winding or unwinding the cable 7*a*.

Figure 4:
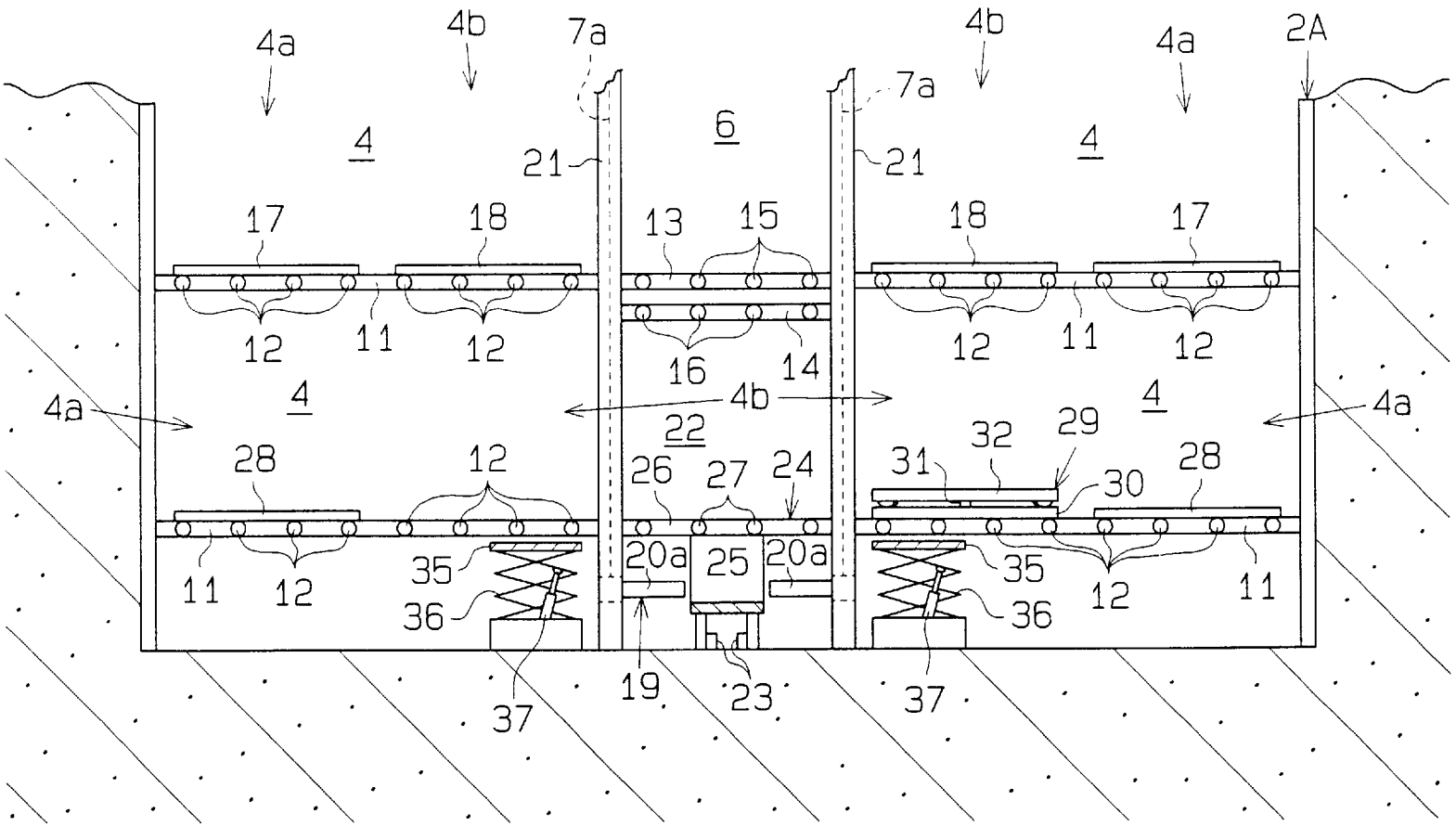
FIG. 4 is a partial diagrammatic cross-sectional view that is an enlargement of the lower part of FIG. 2.
Figure 5:
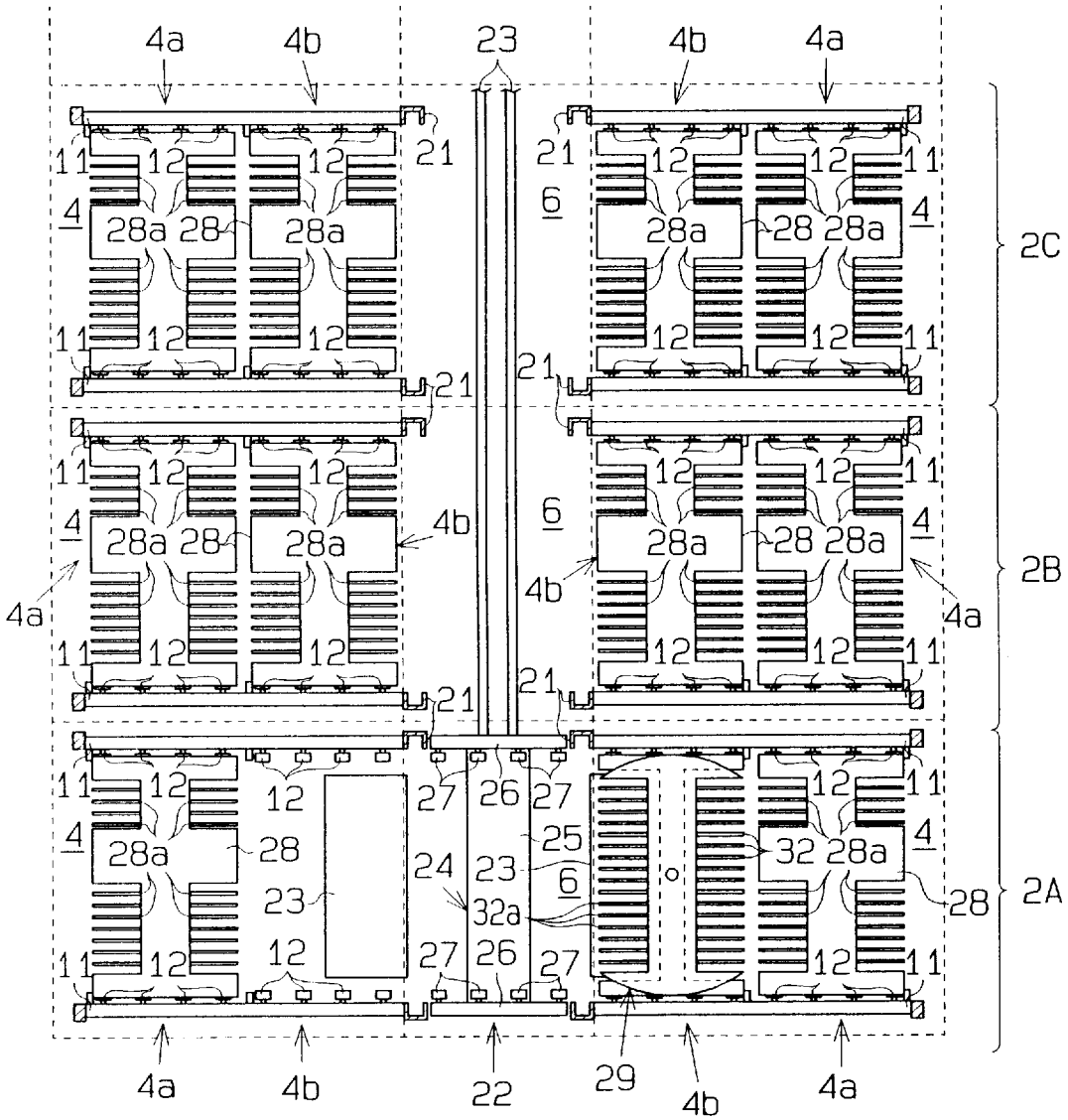
FIG. 5 is a diagrammatic cross-sectional view as seen from the plane indicated by line 5—5 of FIG. 2.

As shown in FIGS. 4 and 5, a transfer passage 22 extends between the frames 2A–2E at the lowermost level in the direction perpendicular to the plane of FIG. 4. The passage 22 thus connects each of the frames 2A–2E. A pair of rails 23, which extend parallel to each other, are provided in the passage 22. A transfer carriage 24 travels along the rails 23.

Figure 7:
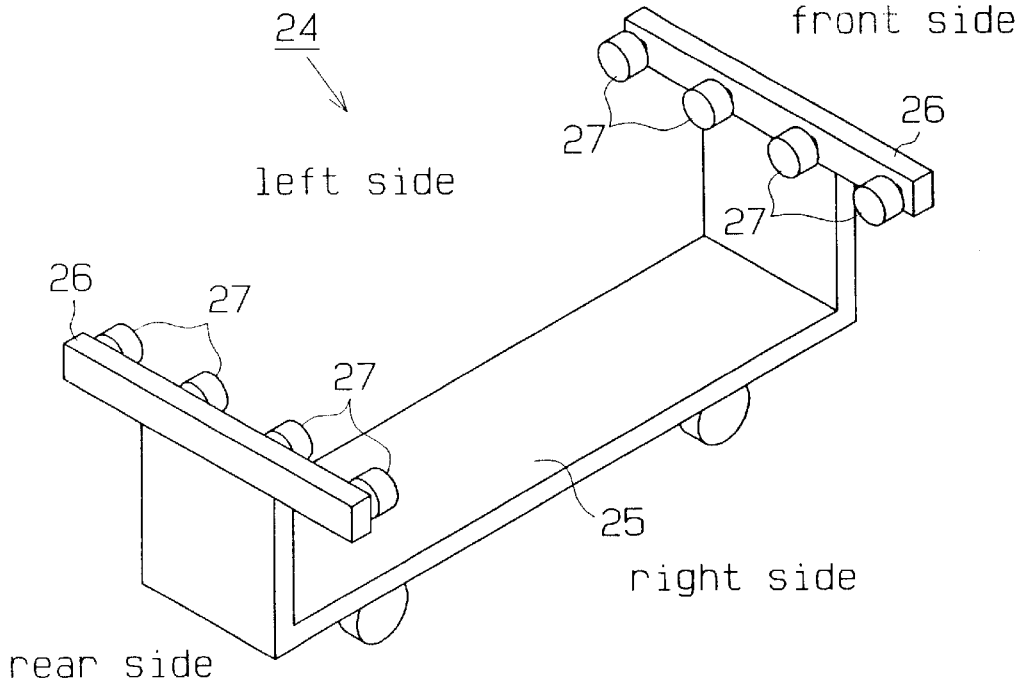
FIG. 7 is a diagrammatic perspective view showing a carriage.

As shown in FIG. 7, the transfer carriage 24 includes a U-shaped base 25 and a pair of support rails 26 extending laterally from the base 25. A plurality of rollers 27 are also provided on the opposing surfaces of each rail 26. The rollers 26 are rotatable in both forward and reverse directions. When the transfer carriage 24 is moved to a position beside one of the storage compartments 4, as shown in FIGS. 4 and 5, the support rails 26 are arranged between and aligned with the left and right guide rails 11.

In most of the lowermost compartments 4, each storing space 4*a*, 4*b* has a transfer tray 28. Thus, there are four transfer trays 28 at most of the lowermost levels of frames 2B–2E. However, as shown in FIG. 5, the lowermost level of frame 2A has only two transfer trays 28, one for each first storing space 4*a*. These compartments 4 at the lowermost level of frame 2A each define a reserved compartment. The transfer trays 28 are supported by the rollers 12 of the rails 11. Comb-like prongs 28*a*, which are identical to the prongs 17*a*, 18*a* of the carry trays 17, 18, are formed in the left and right sides of each transfer tray 28.

As shown in FIG. 4, an orienting tray 29 is supported by the rollers 12 of the rails 11 in the second storing space 4*b* at the right side of the frame 2A. By rotating the rollers 12 of the rails 11 and the rollers 27 of the rails 26 in either the forward or reverse direction, the orienting tray 29 moves between the second storing space 4*b* and the carriage 24.

Figure 6:
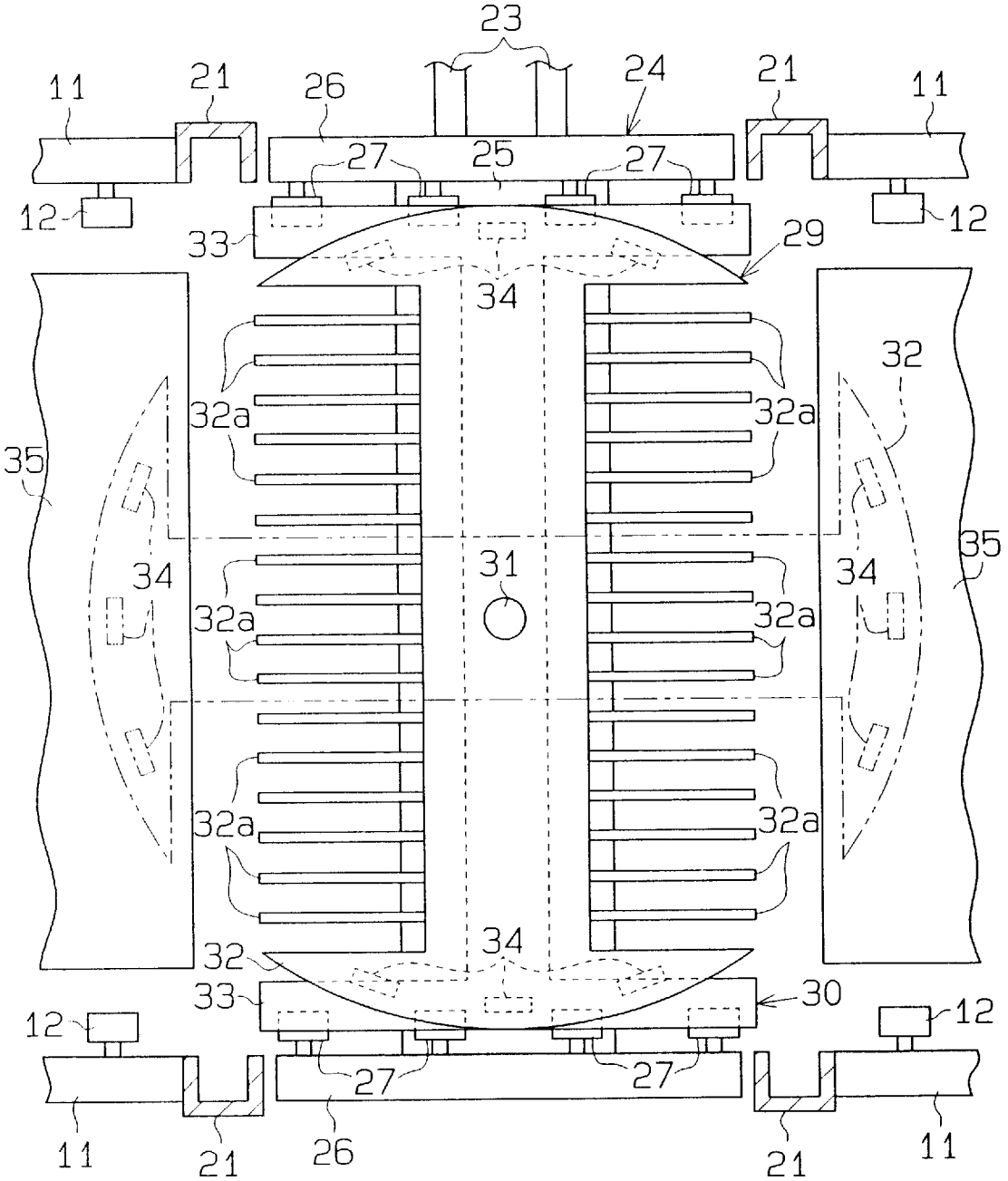
FIG. 6 is a partial enlarged diagrammatic plan view showing an orienting tray.

As shown in FIG. 6, the orienting tray 29 includes a moving floor 30, a center shaft 31, and a turntable 32. The floor 30 extends between the opposed sets of rollers 12, 27 and has support sections at its front and rear end that may be supported by the rollers 12 or 27. The width of the floor 30 in the lateral direction is less than the distance between the left and right prongs 20*a* of the elevator 19. The axis of the center shaft 31 extends upward from the center of the floor 30 and enables rotation of the turntable 32. Prongs 32*a*, which have an interval between one another that is equal to the interval between the prongs 28*a* of the transfer tray 28, are provided on the left and right sides of the turntable 32. The front and rear ends of the turntable 32 are arc-shaped and the center of the arcs coincide with the center shaft 31. A plurality of rollers 34 are rotatably supported under the front and rear ends of the turntable 32.

As shown in FIG. 4, auxiliary floors 35 are provided at the left and right sides of the lowermost section of the elevator path 6 of frame 2A. The auxiliary floors 35 are each supported by a pantograph type expander 36 which is extensible in the vertical direction. A cylinder 37 is connected to the each expander 36 and extends or contracts the expander 36 by expanding or contracting itself. The cylinders 37 and the expanders 36 function as a lifter. When the expander 36 is most extended, the auxiliary floor 35 is moved to a lifted position, and the top surface of the auxiliary floor 35 and the moving floor 30 are aligned in the same plane. When the expander 36 is most contracted, the auxiliary floor 35 is moved to a lowered position and the top surface of the auxiliary floor 35 is lower than the bottom surface of the guide rails 11.

The operation of the vehicle storage apparatus 1 will now be described. To store a vehicle 3 in the storage frame 2A at the first storing space 4*a* of one of the storage compartments 4 above the lowermost level, the elevator 19 is moved to a position below the guide rails 8 of one of the loading stations 5. The vehicle 5 is driven into the loading station 5 and stopped on the loading carriage 10. The rollers 9 of the rails 8 are then rotated to move the loading carriage 10 together with the vehicle 3 into the elevator path 6. When the elevator 19 is raised from below the loading carriage 10, the prongs 20*a* of the elevator 19 pass through the prongs of the loading carriage 10. As a result, the vehicle 3 is received by the prongs 20*a* of the elevator 19 and thus transferred to the elevator 19.

The elevator 19 carries the vehicle 3 to a position where the elevator 19 is located above the guide rails 11 of the designated compartment 4. The first and second tray rails 13, 14 are lifted or lowered to arrange the second rails 14 at the same height as the guide rails 11. The rollers 12 of the guide rails 11 and the rollers 16 of the second rails 14 are then rotated to move the second tray 18 into the elevator path 6. The second tray 18 is supported by the second rails 14 in the elevator path 6. Afterwards, the first and second rails 13, 14 are lifted or lowered to arrange the first rails 13 at the same height as the guide rails 11. The rollers 12 of the guide rails 11 and the rollers 15 of the first rails 13 are then rotated to move the first tray 17 into the elevator path 6. The first tray 17 is supported by the first rails 13 in the elevator path 6.

In this state, the elevator 19 carrying the vehicle 3 is lowered from above the first and second trays 17, 18. As the elevator 19 is lowered, the prongs 20*a* of the elevator 19 passes through the prongs 17*a*, 18*a* of the respective trays 17, 18. This results in the vehicle 3 being transferred to the first tray 17. The first tray 17 is then returned to the first storing space 4*a* by reversing the steps just described. Consequently, the vehicle 3 is stored in the first storing space 4*a*. The second tray 18 is also returned to the second storing space 4*b* by reversing the steps just described.

To store a vehicle 3 in the second storing space 4*b* of one of the storage compartments 4 above the lowermost level, the elevator 19 of the storage frame 2A carries the vehicle 3 to a position where the elevator 19 is located above the guide rails 11 of the designated compartment 4. The second transfer tray 18 is then moved into the elevator path 6 to be supported by either the first or the second rails 13, 14. In this state, the elevator 19 carrying the vehicle 3 is lowered from above the second tray 18. As the elevator 19 is lowered, the prongs 20*a* of the elevator 19 pass through the prongs 18*a* of the transfer tray 18. This results in the vehicle 3 being transferred to the second transfer tray 18. The second tray 18 is then returned to the second storing space 4*b* by reversing the steps just described. Consequently, the vehicle 3 is stored in the second storing space 4*b*.

To retrieve a vehicle 3 from the second storing space 4*b* of a designated compartment 4 of frame 2A, the elevator 19 of the storage frame 2A is moved toward the compartment 4 and positioned below the guide rails 11. The second transfer tray 18 then moves into the elevator path 6 with the vehicle 3 carried thereon. In this state, the elevator 19 is lifted from below the transfer tray 18. As the elevator 19 is lifted, the prongs 20*a* of the elevator 19 pass through the prongs 18*a* of the transfer tray 18. This results in the vehicle 3 being transferred to the elevator 19.

After the elevator 19 receives the vehicle 3, the tray 18 is returned to its original location. Then, the elevator 19 is moved toward the loading station 5 and positioned above the guide rails 8. The loading carriage 10 is then moved into the elevator path 6 and the elevator 19 is lowered from above the carriage 10. As the elevator 19 is lowered, the prongs 20*a* of the elevator 19 pass through the prongs of the loading carriage 10. This results in the vehicle 3 being transferred to the carriage 10. Afterwards, the loading carriage 10 is returned to the loading station 5 with the vehicle 3 carried thereon. The vehicle 3 is subsequently driven out from the loading station 5 and thus removed from the vehicle storage apparatus 1.

To retrieve a vehicle 3 from the first storing space 4*a* of a designated compartment 4, the elevator 19 is moved to the compartment 4 and positioned below the guide rails 11. The first and second tray rails 13, 14 are lifted or lowered to arrange the second rails 14 at the same height as the guide rails 11. The second tray 18 is then moved into the elevator path 6. The second tray 18 is supported by the second rails 14 in the elevator path 6. Afterwards, the first and second rails 13, 14 are lifted or lowered to arrange the first rails 13 at the same height as the guide rails 11. The first tray 17 supporting a vehicle 3 is then moved into the elevator path 6. The first tray 17 is supported by the first rails 13 in the elevator path 6.

In this state, the elevator 19 is lifted from below the first and second trays 17, 18. As the elevator 19 is lifted, the prongs 20*a* of the elevator 19 pass through the prongs 17*a*, 18*a* of the trays 17, 18. This results in the vehicle 3 being received by the prongs 20*a* of the elevator 19. The trays 17, 18 are then replaced in their original locations in a reverse manner. The vehicle 3 is then carried by the elevator 19 and transferred to the carriage 10 in the same manner as described above. The vehicle 3 is subsequently carried by the carriage 10 into the loading station 5 and is subsequently driven out from the loading station 5 and thus removed from the vehicle storage apparatus 1.

When a vehicle 3 is stored into or retrieved from the first storing space 4*a* of a designated compartment 4 with another vehicle 3 stored in the adjacent storing space 4*b*, the vehicle 3 in the second storing space 4*b* is first transferred to the elevator 19 and temporarily stored in another second storing space 4*b*. After the vehicle 3 is stored into or retrieved from the first storing space 4*a*, the vehicle 3 temporarily stored in a separated second storage space 4*b* is returned to its original second storing space 4*b* by the elevator 19.

To store a vehicle 3 in the storage frame 2B at one of the storage compartments 4 above the lowermost level, one of the transfer trays 28 located beside the carriage 24 is moved toward the passage 22 and received by the carriage 24. The carriage 24 then carries the transfer tray 28 into the elevator path 6 of the frame 2A. The elevator 19 of the frame 2B is moved to a position lower than the support rails 26.

The elevator 19 of the frame 2A receives a vehicle 3 at the loading station 5 and is then lowered toward the carriage 24 and transfer tray 28. As the elevator 19 is lowered, the prongs 20*a* of the elevator 19 pass through the prongs 28*a* of the transfer tray 28. As a result, the vehicle 3 is received by the prongs 28*a* of the transfer tray 28 and is thus transferred to the tray 28.

The carriage 24 then carries the transfer tray 28 into the elevator path 6 of the frame 2B. The elevator 19 of the frame 2B is moved upward from below. As the elevator 19 is lifted, the prongs 20*a* of the elevator 19 pass through the prongs 28*a* of the transfer tray 28. This results in the vehicle 3 being received by the prongs 20*a* of the elevator 19 and thus transferred to the elevator 19. The elevator 19 then lifts the vehicle 3 to store the vehicle 3 in the designated compartment of the frame 2B.

To retrieve a vehicle 3 from a designated compartment 4 in the frame 2B, the vehicle 3 is first transferred to the elevator 19 of the frame 2B. The vehicle 3 is then transferred from the elevator 19 to the transfer tray 28 on the carriage 24 and moved into the elevator path 6 of the frame A. The vehicle 3 carried on the carriage 24 is received by the elevator 19 and transported to the loading station 5. Afterwards, the vehicle 3 is driven out from the loading station 5 and is thus removed from the vehicle storage apparatus 1.

Vehicles 3 are stored into and retrieved from compartments 4 of the storage frames 2C–2E above the lowermost level in the same manner as with the frame 2B.

To store a vehicle 3 in the first storing space 4*a* of the left storage compartment 4 at the lowermost level of the frame 2A, the carriage 24 is moved into the elevator path 6 of the frame 2A, as shown in FIG. 5. The transfer tray 28 in the first storing space 4*a* is then moved to the passage 22 and received by the carriage 24. The elevator 19 lowers the vehicle 3 from the loading station 5 and transfers the vehicle 3 to the tray 28. The transfer tray 28 then moves to the first storing space 4*a* to store the vehicle 3 in the space 4*a*. By reversing these steps, the vehicle 3 is retrieved from the vehicle storage apparatus 1.

To store a vehicle 3 in the first storing space 4*a* of the right storage compartment 4 at the lowermost level of the frame 2A, the transfer carriage 24 is moved into the elevator path 6 of the frame 2A. The orienting tray 29 is then moved from the right second storing space 4*b* to the left second storing space 4*b*. The transfer tray 28 in the designated first storing space 4*a* is moved to the passage 22 and received by the transfer carriage 24. In this state, the elevator 19 lowers the vehicle 3 from the loading station 5 and transfers the vehicle 3 to the transfer tray 28. The transfer tray 28 is then moved to the first storing space 4*a* to store the vehicle 3 in the space 4*a*. By reversing these steps, the vehicle 3 may be retrieved from the space 4*a*.

To store a vehicle 3 in either one of the second storing spaces 4*b* of the storage compartment 4 at the lowermost level of the frame 2B, the transfer carriage 24 is moved into the elevator path 6 of the frame 2B. The transfer tray 28 in the storing space 4*b* of the designated compartment 4 is then moved to the passage 22 and received by the transfer carriage 24. The carriage 24 carrying the transfer tray 28 is then moved into the elevator path 6 of the frame 2A.

In this state, the elevator 19 lowers the vehicle 3 from the loading station 5 and transfers the vehicle 3 to the transfer tray 28. The carriage 24 is then moved into the elevator path 6 of the frame 2B. The transfer tray 28 then moves to the second storing space 4*b* to store the vehicle 3 in the space 4*b*. By reversing these steps, the vehicle 3 may be retrieved from the vehicle storage apparatus 1.

To store a vehicle 3 in the first storing space 4*a* of a designated storage compartment 4 at the lowermost level of the frame 2B, the transfer tray 28 of the second storing space 4*b* is moved onto the transfer carriage 24. The transfer tray 28 is then carried to frame 2A and is temporarily stored in the left second storing space 4*b* of the frame 2A. The transfer tray 28 in the designated first storing space 4*a* is then moved to be received by the transfer carriage 24. The carriage 24 is moved into the elevator path 6 of the frame 2A. In this state, the elevator 19 lowers the vehicle 3 from the loading station 5 and transfers the vehicle 3 to the transfer tray 28.

The transfer carriage 24 is then moved into the elevator path 6 of the frame 2B. At this position, the transfer tray 28 carrying the vehicle 3 is moved to the first storing space 4*a* to store the vehicle 3 in the space 4*a*. The transfer tray 28 temporarily stored in the second storing space 4*b* of the frame 2A is returned to its original second storing space 4*b* by the transfer carriage 24. By reversing these steps, the vehicle 3 may be retrieved from the vehicle storage apparatus 1.

Vehicles 3 are stored into and retrieved from compartments 4 of the storage frames 2C–2E at the lowermost level in the same manner as with the frame 2B.

To reverse the orientation of a vehicle 3 stored in a storage frame 2A–2E during its retrieval, the vehicle 3 is conveyed from its designated compartment 4 to the elevator 19 of the frame 2A. When the vehicle 3 is carried on the elevator 19 of the frame 2A, the elevator 19 is positioned above the transfer carriage 24. The carriage 24 is moved into the elevator path 6 of the frame 2A, as shown in FIG. 5, if it is not already located at this position. The orienting tray 29 is then moved into the passage 22 and received by the transfer carriage 24.

In this state, the elevator 19 is lowered toward the orienting tray 29 and the prongs 20*a* of the elevator 19 pass through the prongs 32*a* of the turntable 32. This results in the vehicle 3 being received by the prongs 32*a* of the turntable 32 and thus transferred to the turntable 32. The auxiliary floors 35 at the left and right sides of the transfer carriage 24 are moved to the lifted position causing the top surfaces of the floors 35 and the moving floor 30 to be at the same height. The turntable 32 is rotated about the center shaft 31 with the vehicle 3 carried thereon. During the rotation, the rollers 34 provided under the turntable 32 contact the top surface of the auxiliary floors 35 and roll along the surface.

The turntable 32 is rotated for 180 degrees. The rotation of the turntable 32 reverses the orientation of the vehicle 3 carried thereon. Afterwards, the elevator 19 lifts the orienting tray 29 from below and the prongs 20*a* of the elevator 19 pass through the prongs 32*a* of the turntable 32. This results in the vehicle 3 being received by the prongs 20*a* of the elevator 19 and thus transferred to the elevator 19. After the vehicle 3 is transferred to the elevator 19, the auxiliary floors 35 are lowered to the lowered position. At this position, the top surface of the auxiliary floors 35 are arranged at a position lower than the bottom surface of the guide rails 11.

The orienting tray 29 is then returned to its original position in the second storing space 4*b*. The elevator 19 lifts the vehicle 3 to the loading station 5 and transfers the vehicle 3 in the reoriented state to the loading carriage 10 of the station 5. The vehicle 3 is then retrieved from the vehicle storage apparatus 1 by driving it out from the loading station 5.

As described above, the orienting tray 29 is carried on the transfer carriage 24 only when reversing the orientation of the vehicle 3. Therefore, in comparison with the prior art, the weight of the transfer carriage 24 is reduced when it travels between the frame 2A and the frames 2B–2E carrying the vehicle 3. This increases the traveling speed of the transfer carriage 24 and upgrades the efficiency of storing and retrieving vehicles 3 from the storage compartments 4 of the storage frames 2B–2E.

Additionally, the centers of the moving floor 30 and the turntable 32 are connected to each other by the center shaft 31 and the turntable 32 is rotated about the shaft 31. Therefore, the turntable 32 does not contact the vertical frames 21 and occupies a minimum space. As a result, it is possible to reduce the size of the vehicle storage apparatus 1.

When the turntable 32 is rotated carrying the vehicle 3, the load of the vehicle 3 acts on the auxiliary floors 35 through the rollers 34 provided under the turntable 32. Since the rollers 34 contact the top surface of the floors 35, the rotation of the turntable 32 is performed in a stable manner.

Furthermore, since two vehicles 3 may be stored in each of a plurality of storage compartments 4, the vehicle storing efficiency of the vehicle storage apparatus 1 is enhanced. In addition, the compartments 4 are provided on the left and right sides of the elevator path 6 and the passage 22. This structure further improves the vehicle storing efficiency of the vehicle storage apparatus 1.

Although only one embodiment of the present invention has been described heretofore, it should be apparent to those skilled in the art that the present invention may be embodied in many other specific forms without departing from the spirit or scope of the invention. Particularly, it should be understood that the present invention may also be modified as described below.

(1) The first embodiment described a vehicle parking apparatus 1. However, the present invention may also be embodied in a storehouse for materials such as corrugated cardboard boxes. In such apparatuses, materials are efficiently stored in or retrieved from the storehouse.

(2) In the first embodiment, two vehicles 3 were stored in each compartment 4. However, by widening each compartment 4, three trays may be provided therein for the accommodation of three vehicles 3. In this case, the number of tray rails 13, 14 shall be the same as the number of the carry trays 17, 18. Furthermore, the lowermost level may be provided with three or more second storing spaces 4*b* in which a transfer tray 28 is not accommodated. This structure further improves the storage efficiency of vehicles 3 in the vehicle storage apparatus 1. Contrarily, each compartment 4 may be provided with only a single carry tray or a single transfer tray. This will enable the width of the storage compartment 4 to be reduced thus reducing the size of the vehicle storage apparatus 1.

(3) In the first embodiment, the loading station 5 was provided in the storage frame 2A. However, loading stations 5 may be provided in the other storage frames 2B–2E. Loading stations 5 may also be provided in both the frame 2A and the frame 2E. In such cases, an orienting tray 29 may be provided for each frame 2A, 2E that has a loading station 5.

Figure 8:
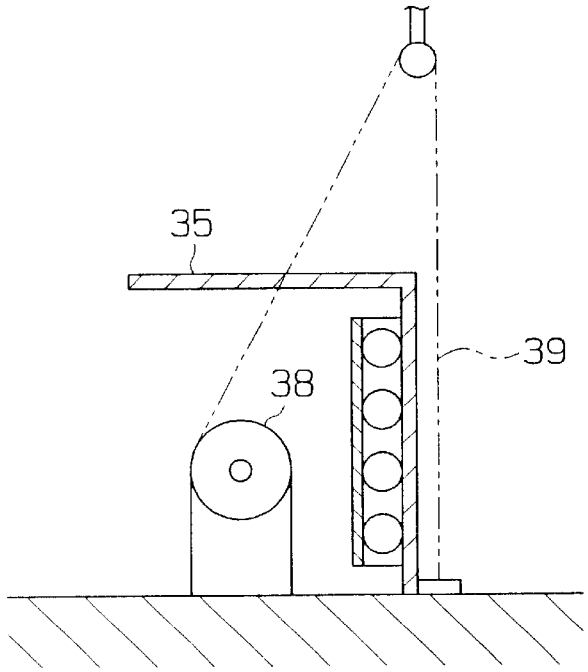
FIG. 8 is a diagrammatic side view of an electric motor and a chain according to another embodiment of the present invention.

(4) Each auxiliary floor 35 was lifted and lowered by the expander 36 and the cylinder 37 in the first embodiment. However, as shown in FIG. 8, the auxiliary floor 35 may be connected to a chain 39, which is wound and unwound by an electric motor 38. In this case, the motor 38 and the chain 39 function as the lifting means and the auxiliary floor 35 is lowered or lifted by winding and unwinding the chain 39 with the motor 38.

(5) In the above embodiments, when storing a vehicle 3 in both the left and right second storing spaces 4*b* of the storage frame 2A at the lowermost level, the orienting tray 29 may be transferred to a separate compartment 4 in the frames 2B–2E. In this case, the transfer tray 28 of the frame 2B–2E carrying a vehicle 3 is conveyed to the left second storing space 4*b* of the frame 2A. The orienting tray 29 is conveyed to the compartment 4 where the transfer tray 28 was originally accommodated. In this state, another transfer tray 28 of the frame 2B–2E carrying a vehicle 3 is conveyed to the right second storing space 4*b* of the frame 2A. This will enable a vehicle 3 to be stored in both the left and right second storing spaces 4*b* of the storage frame 2A at the lowermost level.

(6) In the first embodiment, the orientation of the vehicle 3 was reversed when retrieving it. However, the direction of the vehicle 3 may be reversed when storing it.

Therefore, the present examples and embodiments are to be considered as illustrative and not restrictive and the invention is not to be limited to the details given herein, but may be modified within the scope of the appended claims.

What is claimed is:

1. A storage apparatus for storing objects, comprising:

a set of storage compartments arranged in a group, said group including a reserved compartment;

a transfer passage located adjacent to the group to provide access to the compartments;

an elevator path located within the passage;

an elevator located in the elevator path;

movable trays for selectively transferring the objects from the elevator to each compartment and from the compartments to the elevator;

an orienting tray that is selectively movable between the reserved compartment and the elevator path, the orienting tray being adapted to receive an object from the elevator when the orienting tray is moved to the elevator path and is adapted to re-orient an object within a plane, said orienting tray including a supporting floor that moves laterally between the reserved compartment and the passage, a turntable located above the supporting floor, wherein the turntable is adapted to rotate in a horizontal plane and cooperate with the elevator to transfer objects between the elevator and the turntable, and a center pivot that projects normally from the supporting floor and pivotally supports the turntable;

a liftable auxiliary floor located on each of two opposite sides of the passage, wherein each auxiliary floor is lifted and lowered between an upper position and a lower position by a lifting mechanism; and rollers located beneath the outer periphery of the turntable to support the turntable;

wherein the elevator is adapted to remove a re-oriented object from the turntable when the orienting tray is located in the elevator path;

wherein the upper surface of each auxiliary floor and the supporting floor are aligned in the same plane when the auxiliary floors are lifted to their upper positions; and further wherein the upper surface of each auxiliary floor is spaced from and below the supporting floor when the auxiliary floors are moved to their lower positions.

* * * * *